US010060140B2

(12) United States Patent
Cappelle et al.

(10) Patent No.: US 10,060,140 B2
(45) Date of Patent: Aug. 28, 2018

(54) FLOOR PANEL FOR FORMING A FLOOR COVERING

(71) Applicant: FLOORING INDUSTRIES LIMITED, SARL, Bertrange (LU)

(72) Inventors: Mark Cappelle, Staden (BE); Pieter Devos, Koolskamp (BE)

(73) Assignee: FLOORING INDUSTRIES LIMITED, SARL, Bertrange (LU)

( * ) Notice: Subject to any disclaimer, the term of this patent is extended or adjusted under 35 U.S.C. 154(b) by 0 days.

(21) Appl. No.: 15/110,268

(22) PCT Filed: Jan. 9, 2015

(86) PCT No.: PCT/IB2015/050171
§ 371 (c)(1),
(2) Date: Jul. 7, 2016

(87) PCT Pub. No.: WO2015/104680
PCT Pub. Date: Jul. 16, 2015

(65) Prior Publication Data

US 2016/0333595 A1 Nov. 17, 2016

Related U.S. Application Data

(60) Provisional application No. 61/925,352, filed on Jan. 9, 2014.

(51) Int. Cl.
*E04F 15/00* (2006.01)
*E04F 15/02* (2006.01)
*E04F 15/10* (2006.01)

(52) U.S. Cl.
CPC ..... *E04F 15/02038* (2013.01); *E04F 15/102* (2013.01); *E04F 15/105* (2013.01); *E04F 15/107* (2013.01); *E04F 2201/0153* (2013.01)

(58) Field of Classification Search
CPC . E04F 15/02038; E04F 15/107; E04F 15/102; E04F 15/105; E04F 2201/0153
See application file for complete search history.

(56) References Cited

U.S. PATENT DOCUMENTS 6,505,452 B1 1/2003 Hannig et al.
7,451,578 B2 11/2008 Hannig
(Continued)

FOREIGN PATENT DOCUMENTS

EP 1938963 A1 7/2008
WO 9426999 A1 11/1994
(Continued)

OTHER PUBLICATIONS

International Search Report from corresponding PCT Application No. PCT/IB2015/050171, dated Jun. 25, 2015.

*Primary Examiner* — Patrick J Maestri
(74) *Attorney, Agent, or Firm* — Workman Nydegger

(57) ABSTRACT

A floor panel for forming a floor covering wherein the floor panel is substantially realized on the basis of synthetic material. The floor panel is rectangular and comprises a first pair of opposite edges and a second pair of opposite edges such that both pairs of opposite edges comprise coupling parts allowing for mutually coupling a plurality of such floor panels to each other. The coupling parts of at least the first pair of opposite edges are configured such that two of such panels can be coupled to each other at these edges by means of a turning movement and the coupling parts to this aim consist of a tongue and a groove as well as locking parts, which, in the coupled condition, prevent the shifting apart of tongue and groove. The floor panel has a global thickness which is smaller than or equal to 4.5 millimeters.

22 Claims, 6 Drawing Sheets

(56) References Cited

U.S. PATENT DOCUMENTS

| | | | | |
|---|---|---|---|---|
| 7,896,571 | B1 | 3/2011 | Hannig et al. | |
| 8,024,904 | B2 | 9/2011 | Hannig | |
| 8,071,193 | B2 | 12/2011 | Windmoller | |
| 8,132,384 | B2 | 3/2012 | Hannig | |
| 8,631,621 | B2 | 1/2014 | Hannig | |
| 8,966,853 | B2 | 3/2015 | Hannig | |
| 2002/0014047 | A1* | 2/2002 | Thiers | B44C 1/24 52/313 |
| 2004/0211143 | A1 | 10/2004 | Hanning | |
| 2008/0010938 | A1 | 1/2008 | Hannig | |
| 2008/0138560 | A1 | 6/2008 | Windmoller | |
| 2010/0281803 | A1* | 11/2010 | Cappelle | E04F 15/02 52/309.1 |
| 2011/0088346 | A1 | 4/2011 | Hannig | |
| 2011/0138722 | A1 | 6/2011 | Hannig | |
| 2012/0011796 | A1 | 1/2012 | Hannig | |
| 2013/0047536 | A1 | 2/2013 | Pervan | |
| 2014/0150369 | A1 | 6/2014 | Hannig | |

FOREIGN PATENT DOCUMENTS

| | | | |
|---|---|---|---|
| WO | 0102669 | A1 | 1/2001 |
| WO | 0175247 | A1 | 10/2001 |
| WO | 03016654 | A1 | 2/2003 |
| WO | 2006043893 | A1 | 4/2006 |
| WO | 2006104436 | A1 | 10/2006 |
| WO | 2007015669 | A2 | 2/2007 |
| WO | 2009066153 | A2 | 5/2009 |
| WO | 2009116926 | A1 | 9/2009 |
| WO | 2010023042 | A1 | 3/2010 |
| WO | 2011042878 | A2 | 4/2011 |
| WO | 2011141849 | A2 | 11/2011 |
| WO | 2011141850 | A2 | 11/2011 |
| WO | 2011141851 | A2 | 11/2011 |
| WO | 2012004699 | A2 | 1/2012 |
| WO | 2012004700 | A2 | 1/2012 |
| WO | 2012004701 | A2 | 1/2012 |
| WO | 2012049577 | A2 | 4/2012 |
| WO | 2013118030 | A2 | 8/2013 |
| WO | 2013179260 | A1 | 12/2013 |
| WO | WO2013/179261 | * | 12/2013 |

* cited by examiner

FLOOR PANEL FOR FORMING A FLOOR COVERING

This invention claims the benefit under 35 U.S.C. 119(e) of U.S. provisional application No. 61/925,352.

BACKGROUND OF THE INVENTION

Field of the Invention

This invention relates to a floor panel for forming a floor covering, more particularly for forming a floor covering which can be installed on an underlying surface.

SUMMARY OF THE DISCLOSURE

More particularly, it relates to floor panels which can be coupled to each other by means of mechanical coupling parts.

The aim of the invention consists in that such floor covering can be installed easily, either by applying certain thicknesses in combination with a material choice of the substrate, such that not much installation height must be available, however, there is still sufficient stability in the floor covering, either by applying certain characteristics in the realization of the coupling means, such that the profiles fit better into each other and do not hamper when being inserted into each other and/or when being shifted in respect to each other, or by a combination of both.

To this aim, the invention, according to its first independent aspect, relates to a floor panel for forming a floor covering, wherein this floor panel substantially is realized on the basis of synthetic material and preferably as a layer-shaped substrate; wherein this floor panel is rectangular, either oblong, or square, and thus comprises a first pair of opposite edges and a second pair of opposite edges; wherein both pairs of opposite edges comprise coupling parts which allow mutually coupling a plurality of such floor panels to each other; wherein these coupling parts on both pairs of edges form a first locking system which, in a coupled condition of two of such floor panels, effects a locking in the plane of the floor panels and perpendicular to the respective edges, as well as form a second locking system which, in a coupled condition of two of such floor panels, effects a locking transverse to the plane of the floor panels; wherein these coupling parts on the first pair of opposite edges substantially are realized in the material of the floor panel itself and more particularly in said substrate; wherein the coupling parts of at least the first pair of opposite edges are configured such that two of such panels can be coupled to each other at these edges by means of a turning movement and these coupling parts on the first pair of opposite edges to this aim consist of a tongue and a groove as well as of locking parts which, in the coupled condition, prevent the shifting apart of the tongue and groove; and wherein, on the first pair of opposite edges, the groove is bordered by a lower lip and an upper lip, of which the lower lip extends laterally to beyond the distal end of the upper lip; with the characteristic that the floor panel has a global thickness which is smaller than or equal to 4.5 millimeters. As the floor panel has a global thickness which is smaller than or equal to 4.5 millimeters, in combination with the fact that the floor panel substantially is realized on the basis of synthetic material, the advantage is obtained that less installation height must be available, however, there is still sufficient stability in the floor covering.

According to a preferred embodiment, the floor panel of the first aspect shows the advantage that it is a floor panel of the supple type and/or is of the so-called "resilient floor" type. As the floor panel is of the supple type, amongst others, the advantage is obtained that these floor panels can be installed in an extremely simple manner.

Moreover, the inventor surprisingly has found that with synthetic-based floor panels of small thickness, and in particular with such floor panels of the supple type, in particular due to these small dimensions of the floor panels, the risk of dimensional deformations of the coupling parts and of the floor panels in general can be minimized.

Preferably, the floor panel of the first aspect substantially is composed of a thermoplastic material, preferably a soft thermoplastic material, or anyhow at least one or more base layers of the floor panel consist of such a material.

According to another preferred embodiment, the floor panel of the first aspect shows the characteristic that the floor panel substantially is composed of one or more base layers and at least one top layer.

According to a practical embodiment, the floor panel of the first aspect substantially is realized on the basis of polyvinyl chloride, more particularly on the basis of soft polyvinyl chloride, or at least comprises at least one or more base layers which are realized on the basis of polyvinyl chloride, more particularly soft polyvinyl chloride.

The invention according to its first aspect shows its advantage, amongst others, in particular in the case that the floor panel is a vinyl panel, more particularly a so-called vinyl tile and in particular a floor panel of the so-called LVT type ("Luxury Vinyl Tile") or VCT type ("Vinyl Composite Tile", also named "Vinyl Composition Tile").

In another practical embodiment, the floor panel of the first aspect, or at least one or more base layers thereof, substantially is/are formed on the basis of polyurethane or polypropylene.

According to another preferred embodiment, the floor panel of the first aspect shows the characteristic that the substrate, in one or more layers thereof, in particular base layers thereof, comprises plasticizers. Preferably, the substrate, in one or more layers thereof, in particular base layers thereof, is provided with fillers, such as chalk. It is also noted that by "chalk" all forms of chalk are to be understood, such as also, for example, lime.

Preferably, the floor panel of the first aspect is provided with at least one reinforcement layer, preferably in glass fiber or the like. As the floor panel is provided with such reinforcement layer, it is obtained that the floor panel shows sufficient stability.

In particular, the reinforcement layer extends over the locking groove which is present behind said tongue, in other words, it is located on such a level that it extends above the locking groove. Also, preferably it extends into the tongue. The inventor namely has found that with such configuration of the reinforcement layer an improved stability of the floor panel is achieved.

According to another preferred embodiment of the floor panel of the first aspect, said locking parts are provided with locking surfaces which are located at least partially in the portion of the lower lip which is situated beyond the distal end of the upper lip. As these locking surfaces are located at least partially in the portion of the lower lip which is situated beyond the distal end of the upper lip, the advantage is obtained that such floor panels can be coupled to each other in a smooth manner and that the risk of deformations, which may occur during coupling and which manifest themselves up into the top layer, is minimized.

Preferably, the locking parts of the first pair of opposite edges have a locking distance which is greater than 0.6 times the value of the overall thickness of the floor panel, wherein the locking distance is formed by the horizontal distance between the vertical closing plane of two coupled floor panels and a vertical plane through the middle of the zone over which the locking surfaces of the locking parts, in coupled condition, make contact with each other, as measured in horizontal direction, and wherein the closing plane is defined as a vertical plane through the most distal end of the upper lip. As such locking distance is applied, amongst others, the advantage is created that the required stability and solidity of the coupling is guaranteed. Hereby, it is also achieved that the floor panels can be coupled to each other in a smooth manner.

The floor panel of the first aspect preferably has a locking groove and, at the location of the locking groove, has a minimum thickness which is greater than 0.4 times the minimum thickness of the floor panel. As the floor panel at the location of this locking groove has a minimum thickness which is greater than 0.4 times the overall thickness of the floor panel, it is obtained, amongst others, that the stability of the panels is maintained, whereas the risk of undesired warping, which may be outlined in the upper surface, can be minimized or excluded.

According to another preferred embodiment, the floor panel of the first aspect shows the characteristic that the floor panel, on the first pair of edges, comprises a vertical theoretical closing plane which is determined by a vertical through the most distal end of the upper lip; and that the upper side of the lower lip at the height of this closing plane, in the coupled condition of two of such panels, is located on a level which is situated higher than the level which is determined by the lowermost point of the locking part located on the underside of the tongue, wherein the height difference between the two levels preferably is at least 0.05 times the overall thickness. Hereby, the advantage is created that this lower lip can be made extremely stable, such that cracks in the material of this lower lip can be avoided.

In a particularly preferred embodiment of the floor panel of the first aspect, the overall thickness of the floor panel is four millimeters or less. In particular the application of one or more of the above as well as below described configurations, more particularly the technical realization of the coupling parts, has shown that locking coupling parts can also be integrated efficiently in very thin floor panels.

According to another preferred embodiment of the floor panel of the first aspect, on the first pair of opposite edges the underside of the upper lip is provided with a contact surface for the upper side of the tongue and is this contact surface horizontal or, according to an alternative, is running slightly inclined at an angle to the plane of the floor panel, which angle is less than 7 degrees. As this contact surface is horizontal or, according to an alternative, is running slightly inclined, the advantage is obtained that the required vertical locking between two of such coupled panels can be provided, with a minimum risk of height differences between adjacent floor panels.

Further, the floor panel of the first aspect preferably shows the characteristic that on the first pair of edges, locking surfaces are formed, which there, where they work in conjunction in coupled condition, define a tangent line which extends at an angle of more than 50 degrees and still better more than 60 degrees to the horizontal. As these locking surfaces, there, where they work in conjunction in coupled condition, define a tangent line extending at the aforementioned angle with the horizontal, the advantage is obtained that an optimum horizontal locking can be provided.

According to a preferred embodiment, the floor panel of the first aspect shows the characteristic that the first pair of opposite edges is configured such that, when two of such floor panels are coupled to each other, a contact, herein below named first contact, is present between the underside of the tongue and the upper side of the lower lip, wherein the contact point or contact zone defined by such first contact, seen in cross-section, is situated entirely within two planes which are located parallel to the closing plane, this respectively on both sides of this closing plane, each time one millimeter remote from this closing plane, or still better each time half a millimeter remote therefrom; such that, in other words, the first contact is locally present between said planes and thus does not continue beyond these borders. By making use of such local contact, between this zone and the tip of the tongue, on the underside of this latter, a space remains which provides for that there is a freedom of movement for the tongue during joining, more particularly during turning into each other, of the panels.

Further, preferably in the coupled condition of two of such panels, on said first pair of edges, a space is present underneath the tongue, which space extends from the tip of the tongue at least to beyond a vertical center plane through the zone over which the contact between the upper side of the tongue and the underside of the upper lip extends; that this space ends at a contact, herein after named first contact, formed by a contact point or a contact zone, between the underside of the tongue and the upper side of the lower lip. This contact ends preferably in distal direction of the groove and thus again merges into a space, wherein this transition, in respect to the groove side, is situated proximally to a theoretical vertical plane which, in respect to the groove side, is situated distally at a distance from the closing plane of the floor panel, which distance is smaller than 0.5 times the overall thickness and still better is smaller than 0.25 times the overall thickness; wherein the closing plane is defined as being a vertical plane through the most distal end of the upper lip. This embodiment allows the tongue getting seated in the groove more easily, and also the advantage is created that the tongue can be made relatively massive.

Preferably, said first contact is formed by contact surfaces which theoretically only come together as a line contact, or in cross-section, thus, as a point contact, more particularly in that the theoretical profiles, as determined by the cutting tools applied therewith, can touch each other in a point contact only.

Further, the first contact preferably by cooperating non-parallel, whether or not curved, surfaces on the underside of the tongue and the upper side of the lower lip, wherein preferably either one of these surfaces or both surfaces are non-parallel to the plane of the floor panel.

According to an alternative, the first contact is formed by mutually parallel surfaces on the underside of the tongue and the upper side of the lower lip, wherein these, however, are non-parallel to the plane of the floor panel.

According to another preferred embodiment, the floor panel of the first aspect shows the characteristic that said first contact, in respect to the groove side, is situated entirely distal from a plane extending perpendicular through the point where the contact between the tongue and the upper lip in distal direction of the lip ceases to exist, whereas from said first contact towards the inside of the groove a space is present underneath the tongue which extends from said first contact up to the tip of the tongue. Hereby, the advantage is created that the protruding portion of the tongue can be inserted more easily into the groove without having to maintain very precise tolerances.

Preferably, the respective coupling means are configured such that in coupled condition there is a second contact which, in respect to the groove side, is located proximally from the locking surfaces, however, is separated from the first contact by a space. As in the coupled condition, there is such second contact, which is separated from the first contact by a space, amongst others, the advantage is created that forces which occur when the floor covering is walked on, are distributed over at least two locations, which results in a better force distribution.

In particular, the second contact, in proximal direction of the groove, ends in a point which is located within the distal half of the locking distance.

It is noted that the herein above-described characteristics in the embodiment of the coupling means can also be applied more generally than with floor panels which are substantially made on the basis of synthetic material and which have a global thickness which is smaller than or equal to 4.5 millimeters. So, for example, may these characteristics in the embodiment of the coupling means also be applied in an advantageous manner with a floor panel according to the invention, which, instead of the fact that it substantially consists of synthetic material, now substantially consists of another material. For example, such floor panel consists of a laminate panel with a substrate of MDF or HDF or of a so-called engineered wood panel. Further, the herein above-described characteristics in the embodiment of the coupling means can be advantageously applied with a floor panel according to the invention, which, instead of an overall thickness of smaller than or equal to 4.5 mm, has a thickness which is greater than 4.5 mm.

According to a preferred embodiment, the floor panel of the first aspect shows the characteristic that in the coupled condition of two of such floor panels, a space is present on the aforementioned first pair of edges underneath the tongue, which space extends from the tip of the tongue at least to beyond a vertical center plane through the zone over which the contact between the upper side of the tongue and the underside of the upper lip extends. As the floor panel, in the coupled condition, comprises such space, amongst others, the advantage is obtained that the profiles will fit better into each other and will not hamper during joining and/or during mutual shifting.

Preferably, the floor panel of the first aspect is oblong and the first pair of opposite edges is situated on the long sides.

According to an alternative, the floor panel of the first aspect is oblong and the first pair of opposite edges is situated on the short sides.

According to an interesting embodiment, one or more of the characteristics which are described in the preceding embodiments in relation to the first pair of opposite edges, are also applied on the second pair of opposite edges, and still more preferably even substantially identical coupling parts are applied on the first pair of edges and second pair of edges.

According to a preferred alternative embodiment, the floor panel of the first aspect shows the characteristic that the coupling parts on the second pair of edges are configured such that two of such floor panels at these edges can be coupled to each other by means of a downward movement of one panel in respect to the other, in such a manner that a plurality of such panels can be coupled to each other by means of the so-called "fold-down" technique. It is noted that by this "fold-down" technique a technique is intended such as described, amongst others, in the patent documents WO 01/75247 and WO 01/02669, wherein thus the coupling parts on the first pair of edges are configured such that two of such floor panels can be coupled at their edges by means of a turning movement, whereas thereby, due to the downward movement on the second pair of edges, also automatically a coupling is realized on these edges. In the case of oblong floor panels, the second pair of edges then preferably is formed by the short sides.

In a particularly preferred embodiment, the coupling parts on the second pair of edges comprise a separate locking element in the form of a movable and/or deformable insertion piece which provides for the vertical locking. It is noted that by such separate locking element, a locking element is intended as described, for example, amongst others in the patent documents WO 2006/104436 and WO 2009/066153.

According to another preferred embodiment, the floor panel of the first aspect shows the characteristic that on the first pair of edges the underside of the tongue comprises a step-shaped portion, more particularly a portion formed by a material removal, which, in the coupled condition of two of such panels, in respect to the groove site is situated mainly proximal from a vertical closing plane, wherein this vertical closing plane is defined as a vertical plane through the most distal end of the upper lip. As the underside of the tongue comprises such step-shaped portion, the advantage is obtained that sufficient space can be created on the underside of the tongue, such that the mutual shifting of two of such panels on the first pair of edges can be facilitated.

Preferably, said step-shaped portion of the tongue is formed at least by a first surface on the underside of the tongue, which first surface, in the coupled condition of two of such panels, in respect to the groove side is situated entirely proximal from said vertical closing plane, wherein this first surface, in distal direction in respect to the groove side, merges into a second surface, which is more inclined than said first surface, and wherein the second surface preferably, in respect to the groove side, is situated at least partially proximal from the vertical closing plane.

Said second surface, in distal direction in respect to the groove side, preferably merges into a third surface which, in respect to the horizontal, is less inclined than said second surface, wherein this third surface, in the coupled condition of two of such panels, in respect to the groove side is situated at least partially distal from said vertical closing plane.

It is also noted that by "merge" is meant that the respective surface relatively short therefrom adjoins to the preceding surface, however, that it is not excluded that short transition surfaces, whether or not curved, may be present.

It is noted that by a "more inclined second surface" is meant that this second surface forms a larger angle with the horizontal than the first surface. Also, it is noted that the first surface may be parallel to the horizontal as well as may form an angle therewith.

According to a preferred embodiment, the floor panel of the first aspect shows the characteristic that on the first pair of edges the lower lip comprises a downward-directed recess, more particularly a depression, wherein this downward-directed recess, in the coupled condition of two of such panels, in respect to the groove side is situated mainly or entirely proximal from said vertical closing plane. As the lower lip comprises such downward-directed recess, it is obtained that sufficient space can be created above this lower lip, such that the mutual shifting of two of such panels on the first pair of edges is facilitated, in particularly during installing, wherein the floor panel to be installed is held slightly inclined in respect to a floor panel already installed in a preceding row.

The inventor has found that said step-shaped portion and/or said downward-directed recess can be applied advantageously with floor panels which are substantially realized on the basis of synthetic material. The possibility of creating sufficient space on the underside of the tongue and/or above the upper lip contributes to avoiding the friction which possibly is associated with the mutual shifting of panels, which friction in particular is detrimental with such floor panels of synthetic material, in particular on account of the fact that herein often a so-called "slip stick" effect occurs, and/or a clamping occurs due to bending of the floor panels.

Moreover, the inventor has found that said step-shaped portion and/or said downward-directed recess can be applied extremely advantageous with a floor panel of the first aspect which shows the characteristic that the coupling parts on the second pair of edges are configured such that two of such floor panels can be coupled to each other on these edges by means of a downward movement of one panel in respect to the other, in such a manner that a plurality of such panels can be coupled to each other by means of the so-called "fold-down" technique. In such "fold-down" technique, then in practice the floor panels to be coupled mostly are shifted slightly in mutual respect along the first pair of edges before the actual "fold-down" movement is performed. This mutual shifting of the floor panels can be facilitated by creating sufficient space on the underside of the tongue and/or above the upper lip by means of the step-shaped portion and the downward-directed recess, respectively.

It is noted that the application of such step-shaped portion as such also forms an inventive idea. According to a second aspect, the invention thus also relates to a floor panel for forming a floor covering, wherein this floor panel is rectangular, either oblong, or square, and thus comprises a first pair of opposite edges and a second pair of opposite edges; wherein both pairs of opposite edges comprise coupling parts which allow mutually coupling a plurality of such floor panels to each other; wherein these coupling parts, on both pairs of edges, form a first locking system which, in a coupled condition of two of such floor panels, effects a locking in the plane of the floor panels and perpendicular to the respective edges, as well as form a second locking system which, in a coupled condition of two of such floor panels, effects a locking transverse to the plane of the floor panels; wherein these coupling parts on the first pair of opposite edges substantially are realized in the material of the floor panel itself; wherein the coupling parts of at least the first pair of opposite edges are configured such that two of such panels can be coupled to each other at these edges by means of a turning movement and these coupling parts on the first pair of opposite edges to this aim consist of a tongue and a groove as well as of locking parts which, in the coupled condition, prevent the shifting apart of the tongue and groove; and wherein, on the first pair of opposite edges, the groove is bordered by a lower lip and an upper lip, of which the lower lip extends laterally to beyond the distal end of the upper lip; with the characteristic that on the first pair of edges, the underside of the tongue comprises a step-shaped portion, more particularly a portion formed by a material removal, which, in the coupled condition of two of such panels, in respect to the groove side is situated mainly proximal from a vertical closing plane, wherein this vertical closing plane is defined as a vertical plane through the most distal end of the upper lip. As the underside of the tongue comprises such step-shaped portion, the advantage is obtained that, in relative terms, a large space can be created on the underside of the tongue, such that the mutual shifting of two of such panels on the first pair of edges can be facilitated.

Preferably, said step-shaped portion of the tongue is formed ab least by a first surface on the underside of the tongue, which first surface, in the coupled condition of two of such panels, in respect to the groove side is situated entirely proximal from said vertical closing plane, wherein this first surface, in distal direction in respect to the groove side, merges into a second surface which is more inclined than said first surface, and wherein the second surface preferably, in respect to the groove side, is situated at least partially proximal from the vertical closing plane.

Said second surface, in distal direction in respect to the groove side, preferably merges into a third surface which in respect to the horizontal is less inclined than said second surface, wherein this third surface, in the coupled condition of two of such panels, in respect to the groove side is situated at least partially distal from said vertical closing plane.

As mentioned before, It is also noted that by "merge" is meant that the respective surface relatively short therefrom adjoins to the preceding surface, however, that it is not excluded that short transition surfaces, whether or not curved, may be present.

It is noted that by a "more inclined second surface" is meant that this second surface forms a larger angle with the horizontal than the first surface. Also, it is noted that the first surface may be parallel to the horizontal as well form an angle therewith.

According to another preferred embodiment, the floor panel of the second aspect shows the characteristic that on the first pair of edges the lower lip comprises a downward-directed recess, more particularly a depression, wherein this downward-directed recess, in the coupled condition of two of such panels, in respect to the groove side is situated mainly or entirely proximal from said vertical closing plane. As the lower lip comprises such downward-directed recess, it is obtained that sufficient space can be created above this lower lip, such that the mutual shifting of two of such panels on the first pair of edges is facilitated, in particularly during installing, wherein the floor panel to be installed is held slightly inclined in respect to a floor panel already installed in a preceding row.

The invention is in particular advantageously applied in a floor panel of the second aspect with the characteristic that the coupling parts on the second pair of edges are configured such that two of such floor panels can be coupled on these edges by means of a downward movement of one panel in respect to the other, in such a manner that a plurality of such panels can be coupled to each other by means of the so-called "fold-down" technique. In such "fold-down" technique, then in practice the floor panels to be coupled mostly are shifted slightly in mutual respect along the first pair of edges before the actual "fold-down" movement is performed. This mutual shifting of the floor panels can be facilitated by creating sufficient space according to the herein above-mentioned characteristics of the invention according to its second aspect.

Preferably, the floor panel of the second aspect is substantially made on the basis of a synthetic material, and more particularly it is of the supple type.

It is also noted that any of the characteristics of the second aspect can be combined at random with any of the characteristics of the first aspect, as far as these characteristics are not contradictory.

BRIEF DESCRIPTION OF THE DRAWINGS

With the intention of better showing the characteristics of the invention, herein after, as an example without any limitative character, some preferred embodiments are described, with reference to the accompanying drawings, wherein.

DETAILED DESCRIPTION OF PREFERRED EMBODIMENTS OF THE INVENTION

Figure 1:
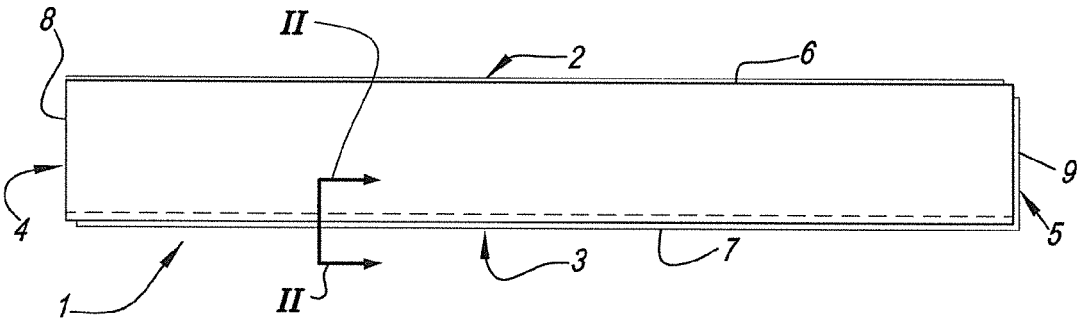
FIG. 1 in top view represents a floor panel according to the invention.
Figure 2:
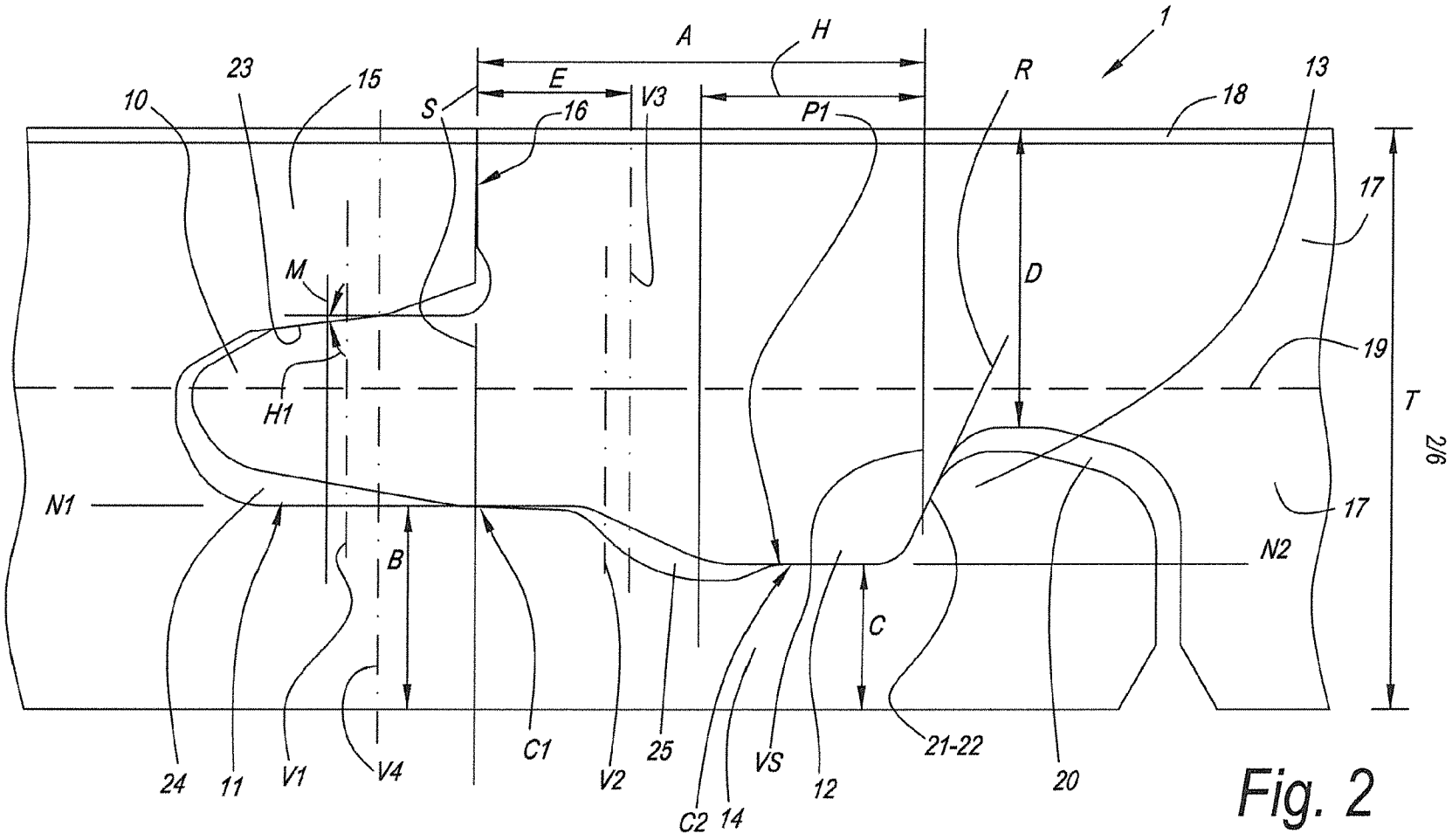
FIG. 2 represents a cross-section according to line II-II in FIG. 1, however, in a condition coupled to a second similar floor panel.

As represented in FIGS. 1 and 2, the floor panel 1 is realized as a layer-shaped substrate, which more particularly is realized substantially on the basis of synthetic material, and preferably on the basis of one of the synthetic materials described in the introduction.

Moreover, the floor panel is oblong rectangular and thus comprises a first pair of opposite edges 2-3 and a second pair of opposite edges 4-5.

Both pairs of opposite edges 2-3 and 4-5 comprise coupling parts 6-7 and 8-9, respectively, which allow mutually coupling a plurality of such floor panels 1 to each other.

These coupling parts 6-7 and 8-9, on both pairs of edges 2-3 and 4-5, form a first locking system which, in a coupled condition of two of such floor panels 1, effects a locking in the plane of the floor panels 1 and perpendicular to the respective edges 2-3-4-5, as well as form a second locking system which, in a coupled condition of two of such floor panels 1, effects a locking transverse to the plane of the panels 1.

The coupling parts 6-7 on the first pair of opposite edges 2-3 substantially are realized in the material of the floor panel 1 itself and more particularly in said substrate, and thus in one piece therewith.

Further, the coupling parts 6-7 are configured such that two of such panels 1 can be coupled to each other at the edges 2-3 by means of a turning movement. To this aim, these coupling parts 6-7 consist of a tongue 10 and a groove 11 as well as of locking parts 12-13 which, in the coupled condition, prevent the shifting apart of the tongue 10 and the groove 11.

It is noted that the coupling parts 8-9 on the second pair of opposite edges 4-5, however, as aforementioned, provide in a horizontal and vertical locking, but that it is clear that these coupling parts 8-9 can be of any kind, whether or not in one piece with the floor panel 1. Also, these coupling parts 8-9 do not necessarily have to allow that two of such floor panels 1 can be coupled to each other at these edges 4-5 by means of a turning movement, however, these coupling parts 8-9 can be configured such that they allow coupling two of such floor panels 1 to each other on these edges 4-5 by means of another mechanism. Herein, it is also noted that FIG. 1 is only a schematic representation of these coupling parts 8-9, as well as of the coupling parts 6-7.

Also, the groove 11 is bordered by a lower lip 14 and an upper lip 15, of which the lower lip 14 extends laterally to beyond the distal end 16 of the upper lip 15.

According to the first aspect, the floor panel 1 shall have a global thickness T which is smaller than or equal to 4.5 millimeters, and in particular preferably is four millimeters or less.

In the represented example, the floor panel 1 is substantially composed of two base layers 17 and one top layer 18, and the floor panel 1 is provided with a reinforcement layer 19, preferably in glass fiber or the like. As represented in FIG. 2, this reinforcement layer 19 preferably extends over the locking groove 20 which is present behind said tongue 10, and in other words, it is located on such a level that it extends above the locking groove 20. Further, it preferably extends into the tongue 10, more particularly preferably up to the tip of this tongue.

It is noted that instead of two base layers 17 also only one base layer or more than two base layers can be used. Also, it is noted that the top layer 18 is not always necessary. In the case that it is applied indeed, as such it may or may not consist of a plurality of layers.

The locking parts 12-13 are provided with locking surfaces 21-22, which are located at least partially in the portion of the lower lip 14 which is situated beyond the distal end 16 of the upper lip 15.

Further, the locking parts 12-13 have a locking distance A which is greater than 0.6 times the value of the overall thickness T of the floor panel 1. Herein, the locking distance A is formed by the horizontal distance between the vertical closing plane S of two coupled floor panels 1 and a vertical plane VS through the middle of the zone over which the locking surfaces 21-22 of the locking parts 12-13, in coupled condition, make contact with each other, as measured in horizontal direction. Herein, the vertical closing plane S is defined as a vertical plane through the most distal end 16 of the upper lip 15.

At the location of the locking groove 20, the floor panel 1 has a minimum thickness D which is greater than 0.4 times the overall thickness T of the floor panel 1.

The upper side of the lower lip 14 at the height of the vertical closing plane S, in the coupled condition of two of such panels 1, is located on a level N1 which is situated higher than the level N2 which is determined by the lowermost point of the locking part located on the underside of the tongue 10, wherein the height difference between the two levels N1 and N2 preferably is at least 0.05 times the overall thickness T.

The underside of the upper lip 15 is provided with a contact surface 23 for the upper side of the tongue 10. This contact surface 23 runs slightly inclined at an angle H1 with the plane of the floor panel 1, which angle H1 preferably is less than 7 degrees. According to an alternative, this contact plane 23 is horizontal.

There, where the locking surfaces 21-22 in coupled condition work in conjunction, they define a tangent line R which extends at an angle of more than 50 degrees and still better more than 60 degrees to the horizontal.

The first pair of opposite edges 6-7 is configured such that, when two of such floor panels 1 are coupled to each other, a contact, herein below named first contact C1, is present between the underside of the tongue 10 and the upper side of the lower lip 14. The contact point or contact zone defined by such first contact C1, seen in cross-section, is situated entirely within two planes V1 and V2 which are located parallel to the closing plane S, this respectively on both sides of this closing plane S, each time one millimeter remote from this closing plane S, or still better each time half a millimeter remote therefrom; such that, in other words, the first contact C1 is locally present between said planes V1 and V2 and thus does not continue beyond these borders.

Further, there is a space 24 present underneath the tongue 10 in the coupled condition of two of such panels 1. This space 24 extends from the tip of the tongue 10 at least to beyond a vertical center plane M through the zone over which the contact between the upper side of the tongue 10 and the underside of the upper lip 15 extends. The space 24 ends at the contact C1, which contact C1, in distal direction of the groove, preferably ends and thus again merges into a space 25, wherein this transition, in respect to the groove side, is situated proximally to a theoretical vertical plane V3 which, in respect to the groove side, is situated distally at a distance E from the closing plane S of the floor panel 1, which distance E is smaller than 0.5 times the overall thickness T and still better is smaller than 0.25 times the overall thickness T.

Said first contact C1 is formed by contact surfaces which theoretically only come together as a line contact, or in cross-section, thus, as a point contact, more particularly in that the theoretical profiles, as determined by the cutting tools applied therewith, can touch each other in a point contact only.

As represented, said first contact C1 preferably is formed by cooperating non-parallel, whether or not curved, surfaces on the underside of the tongue 10 and the upper side of the lower lip 14, wherein preferably either one of these surfaces or both surfaces are non-parallel to the plane of the floor panel 1.

According to a not-represented alternative, the first contact C1 is formed by mutually parallel surfaces on the underside of the tongue 10 and the upper side of the lower lip 14, wherein these, however, are non-parallel to the plane of the floor panel 1.

Further, the first contact C1, in respect to the groove side, is situated entirely distal from a plane V4 extending perpendicular through the point where the contact between the tongue 10 and the upper lip 15 in distal direction of the lip ceases to exist, which is advantageous for the possibility of turning.

The respective coupling means are configured such that in coupled condition there is a second contact C2, which, in respect to the groove side, is located proximally from the locking surfaces 21-22, however, is separated from the first contact C1 by a space 25.

The second contact C2, in proximal direction of the groove, ends in a point P1 which is located within the distal half H of the locking distance A.

It is also noted that one or more characteristics which were described herein above in respect to the first pair of edges 2-3, can also be applied on the second pair of edges 4-5, at least when similar coupling parts are applied there. Possibly, herein substantially identical coupling parts can be applied on the first pair of edges 2-3 and the second pair of edges 4-5.

According to a preferred alternative embodiment, however, the coupling parts 8-9 on the second pair of edges 4-5 are configured such that two of such floor panels 1 at these edges 4-5 can be coupled to each other by means of a downward movement of one floor panel in respect to the other, in such a manner that a plurality of such floor panels 1 can be coupled to each other by means of a so-called "fold-down" technique. Still more preferably, the coupling parts 8-9 on the second pair of edges 4-5 then comprise a separate locking element in the form of a movable and/or deformable insertion piece which provides for the vertical locking.

Figure 3:
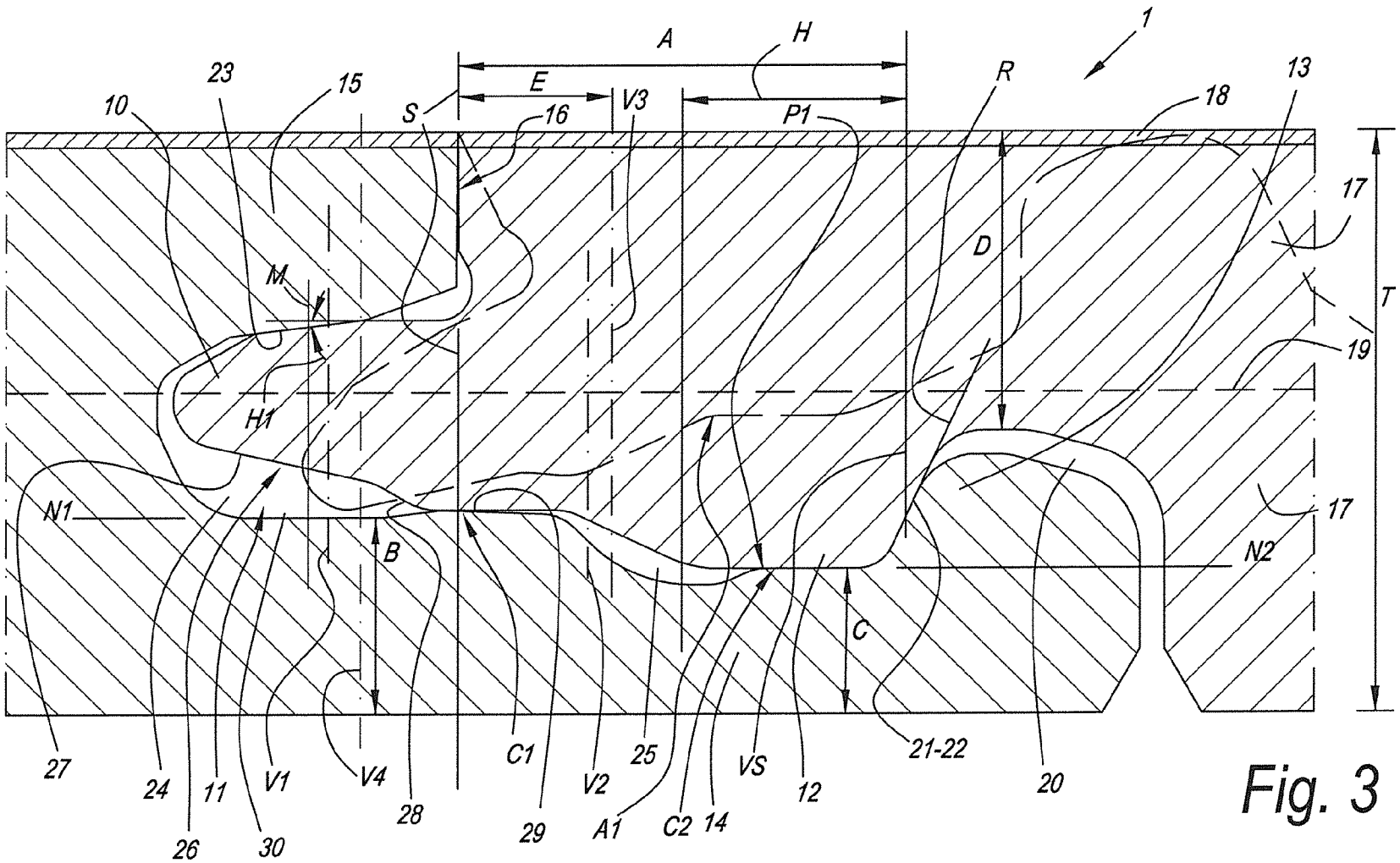
FIG. 3 represents another preferred embodiment according to a view analogous to FIG. 2.

In FIG. 3, another preferred embodiment is represented of the first pair of edges 2-3 of a floor panel 1 of the invention, in the coupled condition of two of such floor panels 1. On this first pair of edges 2-3, the underside of the tongue 10 comprises a step-shaped portion 26, which, in the coupled condition of two of such panels 1, in respect to the groove side is situated mainly proximal from the vertical closing plane S, wherein this vertical closing plane S, as mentioned before, is defined as a vertical plane through the most distal end 16 of the upper lip 15. More particularly, this step-shaped portion 26 is formed by a material removal on the underside of the tongue 10.

The step-shaped portion 26 of the tongue 10 is formed at least by a first surface 27 on the underside of the tongue, which first surface 27, in the coupled condition of two of such floor panels 1, in respect to the groove side is situated entirely proximal from said vertical closing plane S. This first surface 27, in distal direction in respect to the groove side, merges into a second surface 28, which in respect to the horizontal is more inclined than said first surface 27. The mentioned second surface 28, in respect to the groove side, preferably is situated at least partially proximal from the vertical closing plane S, and still more preferably in respect to the groove side is situated entirely proximal from the vertical closing plane S.

In distal direction in respect to the groove side, the mentioned second surface 28 merges into a third surface 29, which, in respect to the horizontal, is less inclined than the second surface 28. In the coupled condition of two of such floor panels 1, in respect to the groove side this third surface 29 is situated at least partially distal from said vertical closing plane S.

Still on the first pair of edges 2-3, the lower lip 14 comprises a downward-directed recess 30, more particularly a depression. This downward-directed recess 30, in the coupled condition of two of such floor panels 1, in respect to the groove side is situated entirely proximal from the vertical closing plane S. It is also noted that according to an alternative, this downward-directed recess 30 may be situated mainly proximal from said vertical closing plane.

As already mentioned in the introduction, said step-shaped portion 26 and/or said downward-directed recess 30 allow, in relative terms, to create a large space on the underside of the tongue 10 and above the lower lip 14, such that the friction, which possibly is associated with the mutual shifting of such floor panels 1, can be minimized and preferably avoided, in particular during installation, wherein the floor panel 1 to be installed is held slightly inclined in respect to a floor panel 1 already installed in a preceding row. Such slightly inclined position of a floor panel 1 is illustrated schematically in FIG. 3 by means of the represented profiling A1, which corresponds to the profiling of the floor panel 1 with the tongue 10 illustrated in FIG. 3. It is clear that shifting this slightly inclined floor panel 1 with the tongue 10 in respect to the floor panel 1 with the groove 11 along the first pair of edges 2-3, and thus in a direction perpendicular to the plane of the cross-section represented in FIG. 3, may be performed with a minimum or preferably even without friction.

Figure 4:
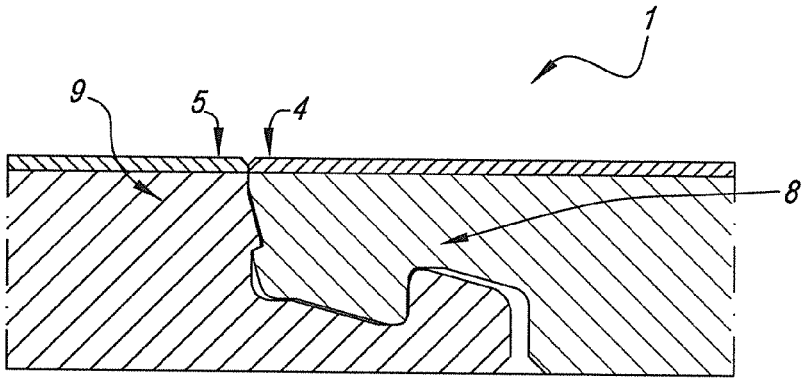
FIG. 4 in cross-section represents a possible embodiment of a second pair of edges of a floor panel according to the invention, in coupled condition of two of such floor panels.

In FIG. 4, a possible embodiment is represented of the second pair of edges 4-5 of a floor panel according to the invention, in coupled condition of two of such floor panels.

Figure 5:
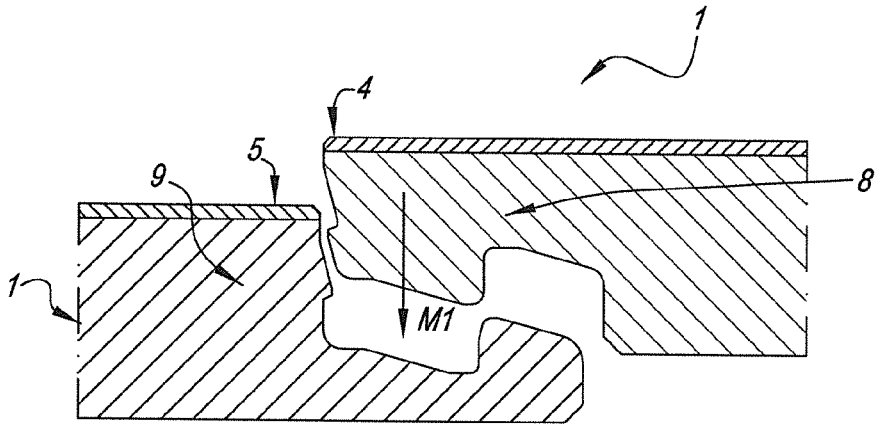
FIG. 5 represents a view analogous to FIG. 4, however, during coupling.

The coupling parts 8-9 on this second pair of edges 4-5 are configured such that two of such floor panels 1 can be coupled on these edges 4-5 by means of a downward movement of one floor panel 1 in respect to the other floor panel 1, in such a manner that a plurality of such floor panels 1 can be coupled to each other by means of the so-called "fold-down" technique. Said downward movement is represented in FIG. 5, which represents a view analogous to FIG. 4, however, during coupling of the floor panels 1, and is indicated by reference M1.

Figure 6:
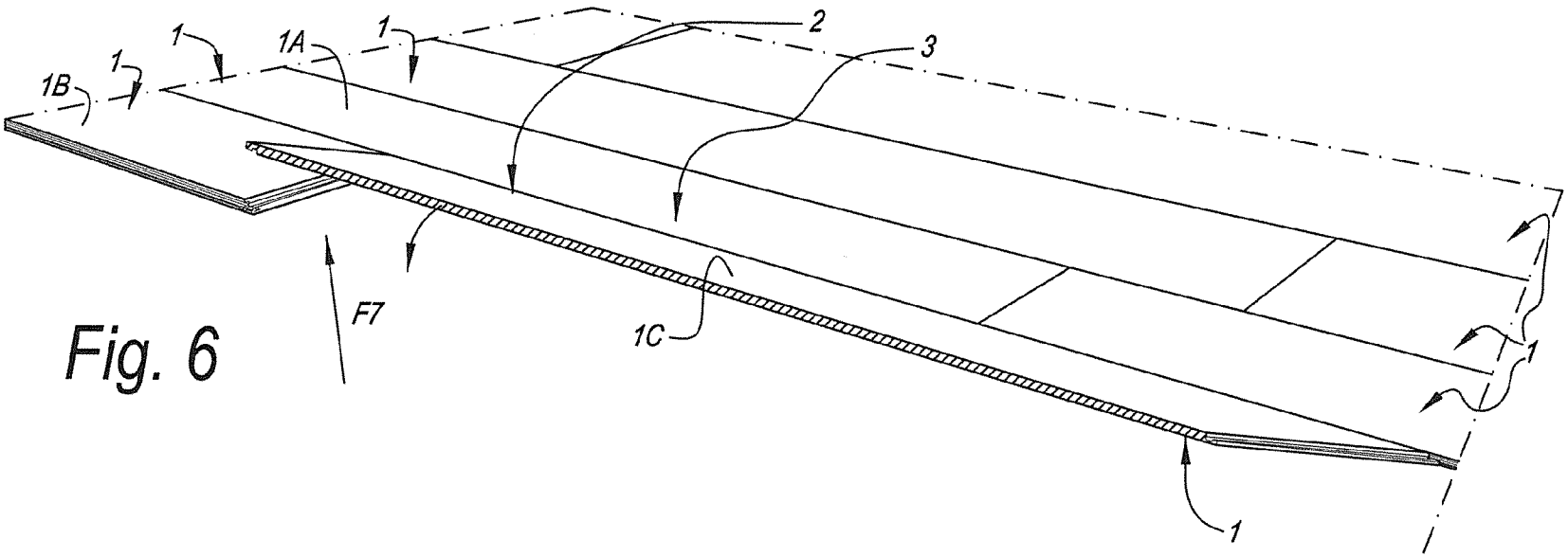
FIG. 6 represents how such floor panels can be mutually connected.

In such floor panels 1, which can be coupled to each other by means of the so-called "fold-down" technique, as also mentioned in the introduction, the step-shaped portion 26 and/or the downward-directed recess 30 can be used in an advantageous manner. This "fold-down" technique is represented in FIG. 6. In order to explain the method, for extra distinction some of the floor panels 1 then are indicated by references 1A, 1B and 1C. The floor panels 1 are installed row by row and coupled to each other. In order to obtain that the panels are coupled at the edges 2-3 as well as 4-5, the method comprises at least the following steps:

Installing a first panel 1A which is intended for forming part of a first row of panels;

coupling a second panel 1B to said first panel 1A, this at first edges 2-3, wherein this second panel 1B is intended for forming part of a second row, following said first row of panels;

coupling in the second row a third panel 1C to said second panel 1B as well as to the first panel 1A, wherein the third panel 1C is coupled to the first panel 1A by means of a turning movement, wherein the third panel 1C is brought from an upward-turned position into substantially the same plane as the first and second panels, whereas as a consequence of this movement and the created therewith downward movement, the coupling parts 8-9 between the third and second panels engage in each other.

Figure 7:
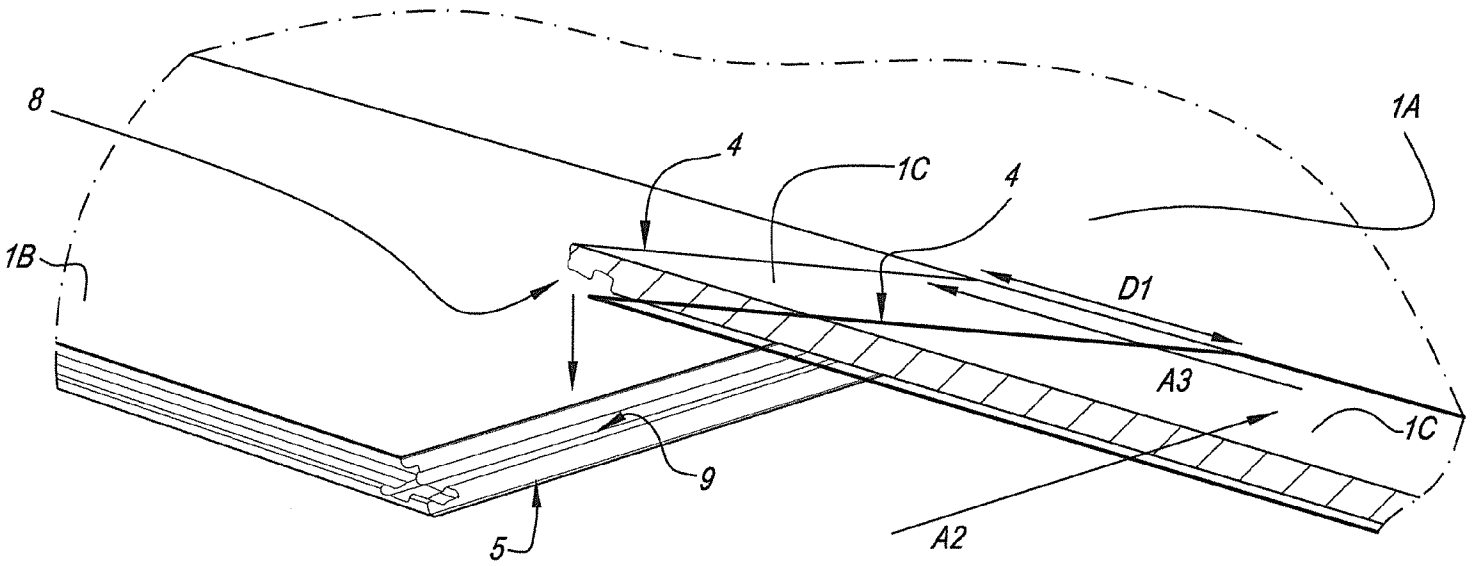
FIG. 7, at a larger scale, represents the portion indicated by arrow F7 in FIG. 6.

In practice, the third floor panel 1C and the first floor panel 1A mutually are shifted slightly along the respective first pair of edges 2-3 before performing the actual "fold-down" movement. This is explained in more detail by means of FIG. 7, which at a larger scale represents the portion indicated by arrow F7 in FIG. 6. Practically, the third floor panel 1C is provided on the first floor panel 1A according to a direction A2, and this in a slightly inclined position, as schematically represented by the floor panel 1C shown in bold print. Herein, the edge 4 of the third floor panel 1C still is situated at a horizontal distance D1 from the edge 5 of the second floor panel 1B. It is noted that this distance D1 in reality is minute, more particularly several millimeters, however, for clarity's sake here is represented relatively large. Subsequently, the third floor panel 1C is shifted in respect to the first floor panel 1A according to a direction A3, such that thereafter the third floor panel 1C can be brought from the upward-turned position into substantially the same plane as the first and second floor panels and can be coupled to the second floor panel 1B. It is clear that with such shifting, as already mentioned, it is advantageous to provide a relatively large space, such that the friction, which possibly is associated with the mutual shifting of such floor panels 1, can be minimized and preferably can be avoided.

It is clear that this in the first place relates to decorative floor panels, thus, with a decorative upper side, for forming a floor covering on an existing carrying floor, and more particularly for forming a floating floor covering.

The invention is intended in particular for floor panels which substantially consist of synthetic material, or which comprise at least one or more base layers on the basis of synthetic material, and still more for floor panels of the supple type. More particularly, the invention shows its advantages best with vinyl panels, in particular so-called vinyl tiles, and in particular with panels of the so-called LVT type ("Luxury Vinyl Tile") or VCT type ("Vinyl Composite Tile", also named "Vinyl Composition Tile").

Such synthetic material floor panel, and in particular supple synthetic material floor panel, and more particularly such vinyl tile, preferably shows one or more of the following characteristics:

the floor panel substantially is composed of one or more base layers and at least one top layer, wherein the top layer as such may or may not be composed of a plurality of layers;

herein, the top layer comprises at least a decorative layer, preferably in the form of a print, preferably provided on a foil or film, possibly covered still further by one or more wear layers, for example, either in the form of a transparent foil, or in the form of a transparent lacquer, for example, a polyurethane lacquer, or a combination thereof;

the top layer comprises at least a translucent or transparent wear layer;

the floor panel substantially is composed of a thermoplastic material, preferably a soft thermoplastic material;

the floor panel, or anyhow at least the one or more base layers thereof, is/are substantially composed of polyvinyl chloride, more particularly soft polyvinyl chloride, more particularly provided with plasticizers or similar; a composition "substantially" on the basis of PVC must be interpreted broadly, as a large number of additives, for example, fillers, can be applied in PVC floors;

the floor panel comprises at least one reinforcement layer, preferably formed of fibers, more particularly reinforcement fibers, such as glass fibers.

It is noted that "soft PVC" is a term expressing that this relates to supple PVC, in other words, PVC which is relatively smoothly bendable. The term soft PVC is commonly known in the technique. Such soft PVC consists of PVC which is softened, for example, by means of a plasticizer added during the production process. Depending on the added amount of plasticizers, of course various degrees of suppleness can be achieved.

By a plasticizer any material has to be understood which, when added, results in a more supple PVC. Typical examples are phthalate plasticizers and isosorbide plasticizers.

By PVC which is softened, of course also PVC can be understood, or a composition on the basis of PVC can be understood, which, for example, because it has been modified, as such has the feature of being supple.

The same is valid for other "soft synthetic materials" and the above is not restricted to PVC.

As herein above already stated, the present invention shows its advantages in particular when it is applied to floor panels which substantially are manufactured of supple or soft synthetic material, or in other words, with supple panels.

By supple floor panels, floor panels are meant which, when they, in the case of a rectangular panel having a width of, for example, less than 50 centimeters, are clamped on one of the two short sides of the panel and hereby protrude over a length of 100 centimeters and are not supported, the panels will bend under the influence of their own weight, wherein this bending at the height of the free extremity in respect to the clamped extremity is minimum 10 centimeters. For this bending, a bending time of 10 seconds is observed, and wherein the panel starts from a flat horizontal position.

It is clear that the coupling parts in free condition preferably show a somewhat overlapping design, such that the floor panels in coupled condition become seated in each other with a so-called "pretension".

The present invention is in no way limited to the embodiment described herein above and represented in the figures, on the contrary may such floor panel be realized in various forms and dimensions without exceeding the scope of the invention.

So, for example, it is noted that although in FIG. 1 an oblong panel is represented, the invention can also be applied in square floor panels. Also, the edges of the first pair of opposite edges in FIG. 1 are indicated by the edges 2-3 of the long sides, however, it is clear that by definition the first pair of edges might also be present on the short sides, whereas the second pair of edges then is present on the long sides.

The invention claimed is:

1. A floor panel for forming a floor covering, wherein the floor panel comprises a substrate based on a synthetic material formed as one or more base layers;

wherein the floor panel is of the supple type and is rectangular, either oblong or square, and thus comprises a first pair of opposite edges and a second pair of opposite edges;

wherein both pairs of opposite edges comprise coupling parts which allow mutually coupling a plurality of such floor panels to each other;

wherein said coupling parts, on both pairs of edges, form a first locking system which, in a coupled condition of two of such floor panels, effects a locking in the plane of the floor panels and perpendicular to the respective edges, as well as form a second locking system, which, in a coupled condition of two of such floor panels, effects a locking transverse to the plane of the floor panels;

wherein these coupling parts on the first pair of opposite edges substantially are formed of the material of the floor panel itself and in said substrate;

wherein the coupling parts of at least the first pair of opposite edges are configured such that two of such panels can be coupled to each other at these edges by means of a turning movement, and to this aim these coupling parts on the first pair of opposite edges consist of a tongue and a groove as well as of locking parts which, in the coupled condition, prevent the shifting apart of the tongue and groove;

wherein, on the first pair of opposite edges, the groove is bordered by a lower lip having an upper side and an upper lip, of which the lower lip extends laterally to beyond the most distal end of the upper lip;

wherein the floor panel has a global thickness (T) which is smaller than or equal to 4.5 millimeters;

wherein the locking parts of the first pair of opposite edges have a locking distance (A) which is greater than 0.6 times the value of the overall thickness (T) of the floor panel, the locking distance (A) being formed by the horizontal distance between a vertical closing plane (S) of two coupled floor panels and a vertical plane (VS) through the middle of the zone over which the locking surfaces of the locking parts, in coupled condition, make contact with each other, as measured in horizontal direction, and the closing plane (S) being defined as a vertical plane through the most distal end of the upper lip;

wherein the upper side of the lower lip at the height of said closing plane, in the coupled condition of two of such panels, is located on a level (N1) which is situated higher than a level (N2) which is determined by a lowermost point of the locking part located on the underside of the tongue, wherein the height difference between the two levels (N1 and N2) is at least 0.05 times the overall thickness (T);

wherein, seen in a cross section perpendicular to coupled edges of said first pairs of edges, the tongue has a tongue portion extending from the closing plane to the tip of the tongue, said tongue portion having an underside, wherein the underside of said tongue portion defines one or more portions that, from a proximal position to a distal position, are upwardly inclined, wherein seen in said cross section said one or more portions define a majority of said underside of said tongue portion; and wherein in the coupled condition of two of such floor panels, a space is present on the aforementioned first pair of edges underneath the tongue, which space extends from the tip of the tongue at least to beyond a vertical center plane (M) through the zone over which the contact between the upper side of the tongue and the underside of the upper lip extends.

2. The floor panel of claim 1, wherein the floor panel substantially is composed of a soft thermoplastic material, or that at least one or more base layers of the floor panel consist of such a material.

3. The floor panel of claim 1, wherein the floor panel includes polyvinyl chloride, soft polyvinyl chloride, or at least one or more base layers which include polyvinyl chloride or soft polyvinyl chloride.

4. The floor panel of claim 1, wherein the floor panel is a vinyl panel.

5. The floor panel of claim 1, wherein the floor panel or one or more base layers of the floor panel are formed of polyurethane or polypropylene.

6. The floor panel of claim 1, wherein the substrate, in one or more base layers thereof, comprises plasticizers.

7. The floor panel of claim 1, wherein the substrate, in one or more layers thereof, is provided with one or more fillers.

8. The floor panel of claim 1, wherein it is provided with at least one reinforcement layer of glass fiber.

9. The floor panel of claim 1, wherein the floor panel comprises a locking groove and that the floor panel, at the location of the locking groove, has a minimum thickness which is greater than 0.4 times the overall thickness of the floor panel.

10. The floor panel of claim 1, wherein on the first pair of opposite edges, an underside of the upper lip is provided with a contact surface for an upper side of the tongue and that the contact surface is horizontal or alternatively runs slightly inclined at an angle with a plane in which the floor panel extends, wherein the angle is less than 7 degrees.

11. The floor panel of claim 1, wherein on the first pair of edges locking surfaces are formed which, in coupled condition, define a tangent line which extends at an angle of more than 50 degrees and still better more than 60 degrees to the horizontal.

12. The floor panel of claim 1, wherein the first pair of opposite edges is configured such that, when two of such floor panels are coupled to each other, a contact, herein below named first contact (C1), is present between the underside of the tongue and the upper side of the lower lip, wherein a contact point or contact zone defined by such first contact (C1), seen in cross-section, is situated entirely within two planes (V1 and V2) which are located parallel to the closing plane (S), this respectively on both sides of the closing plane, each time one millimeter or half a millimeter remote from the closing plane (S), such that the first contact (C1) is locally present between said planes (V1 and V2) and thus does not continue beyond these borders.

13. The floor panel of claim 1, wherein in the coupled condition of two of such panels, on said first pair of edges, a first space is present underneath the tongue, the first space extending from the tip of the tongue at least to beyond a vertical center plane (M) through the zone over which the contact between the upper side of the tongue and the underside of the upper lip extends;

wherein the first space ends at a contact, herein after named first contact (C1), formed by a contact point or a contact zone, between the underside of the tongue and the upper side of the lower lip;

wherein the first contact (C1), in distal direction of the groove, ends at a second space, wherein the transition, in respect to the groove side, is situated proximally to a theoretical vertical plane (V3), which, in respect to the groove side, is situated distally at a distance (E) from the closing plane (S) of the floor panel, which distance is smaller than 0.5 times the overall thickness (T) or smaller than 0.25 times the overall thickness (T); and wherein the closing plane is defined as being a vertical plane through the most distal end of the upper lip.

14. The floor panel of claim 12, wherein the respective coupling means are configured such that in coupled condition there is a second contact (C2) which, in respect to the groove side, is located proximally from the locking surfaces, however, is separated from the first contact by a space.

15. The floor panel of claim 14, wherein the second contact (C2), in proximal direction of the groove, ends in a point (P1) which is located within a distal half (H=A/2) of the locking distance (A).

16. The floor panel of claim 1, wherein the coupling parts on the second pair of edges are configured such that two of such floor panels at these edges can be coupled to each other by means of a downward movement of one panel in respect to the other, in such a manner that a plurality of such panels can be coupled to each other by means of the so-called "fold-down" technique.

17. The floor panel of claim 1, wherein on the first pair of edges the underside of the tongue comprises a step-shaped portion which, in the coupled condition of two of such panels, in respect to the groove side is situated mainly proximal from said vertical closing plane.

18. A floor panel for forming a floor covering, wherein the floor panel is rectangular, either oblong, or square, and thus comprises a first pair of opposite edges and a second pair of opposite edges;

wherein both pairs of opposite edges comprise coupling parts which allow mutually coupling a plurality of such floor panels to each other;

wherein these coupling parts on both pairs of edges form a first locking system, which, in a coupled condition of two of such floor panels, effects a locking in the plane of the floor panels and perpendicular to the respective edges, as well as form a second locking system, which, in a coupled condition of two of such floor panels, effects a locking transverse to the plane of the floor panels;

wherein these coupling parts on a first pair of opposite edges substantially are formed of the material of the floor panel itself;

wherein the coupling parts of at least the first pair of opposite edges are configured such that two of such panels can be coupled to each other at these edges by means of a turning movement and these coupling parts on the first pair of opposite edges to this aim consist of a tongue and a groove as well as of locking parts which, in the coupled condition, prevent the shifting apart of the tongue and groove;

wherein, on the first pair of opposite edges, the groove is bordered by a lower lip and an upper lip, of which the lower lip extends laterally to beyond the most distal end of the upper lip;

wherein on the first pair of edges the underside of the tongue comprises a step-shaped portion which, in the coupled condition of two of such panels, in respect to the groove side is situated mainly proximal from a vertical closing plane (S), wherein the vertical closing plane (S) is defined as a vertical plane through the most distal end of the upper lip;

wherein said step-shaped portion of the tongue is at least formed by a first surface on the underside of the tongue, which first surface, in the coupled condition of two of such panels, in respect to the groove side is situated entirely proximal from said vertical closing plane, wherein the first surface is inclined and wherein the first surface, in a distal direction in respect to the groove side, merges into a second surface, which is more inclined than said first surface, and wherein the second surface in respect to the groove side is situated at least partially proximal from the vertical closing plane;

wherein said second surface, in distal direction in respect to the groove side, merges into a third surface, which, in respect to the horizontal, is less inclined than the second surface, wherein the third surface, in the coupled condition of two of such panels, in respect to the groove side is situated at least partially distal from said vertical closing plane;

wherein, seen in a cross section perpendicular to coupled edges of first pairs of edges, the tongue has a tongue portion extending from the closing plane to the tip of the tongue, said tongue portion having an underside;

wherein, seen in said cross section, said first surface and second surface together define the majority of said underside; and wherein the locking parts of the first pair of opposite edges have a locking distance (A) which is greater than 0.6 times the value of the overall thickness (T) of the floor panel, the locking distance (A) being formed by the horizontal distance between a vertical closing plane (S) of two coupled floor panels and a vertical plane (VS) through the middle of the zone over which the locking surfaces of the locking parts, in coupled condition, make contact with each other, as measured in horizontal direction, and the closing plane (S) being defined as a vertical plane through the most distal end of the upper lip.

19. The floor panel of claim 18, wherein on the first pair of edges, the lower lip comprises a downward-directed recess including a depression, wherein the downward-directed recess, in the coupled condition of two of such panels, in respect to the groove side is situated mainly or entirely proximal from said vertical closing plane.

20. The floor panel of claim 18, wherein the coupling parts on the second pair of edges are configured such that two of such floor panels can be coupled to each other at these edges by means of a downward movement of one panel in respect to the other, in such a manner that a plurality of such panels can be coupled to each other by means of the so-called "fold-down" technique.

21. The floor panel of claim 18, wherein the floor panel substantially is made of a soft synthetic material.

22. The floor panel of claim 7, wherein the substrate, in the one or more layers thereof, includes chalk as at least one of the one or more fillers.

* * * * *